US006565176B2

(12) United States Patent
Anderson et al.

(10) Patent No.: US 6,565,176 B2
(45) Date of Patent: May 20, 2003

(54) LONG-LIFE STABLE-JETTING THERMAL INK JET PRINTER

(75) Inventors: Frank Edward Anderson, Sadieville, KY (US); Thomas Austin Fields, Winchester, KY (US); Paul William Graf, Lexington, KY (US); Yimin Guan, Lexington, KY (US); George Keith Parish, Winchester, KY (US); Kent Lee Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/865,881

(22) Filed: May 25, 2001

(65) Prior Publication Data

US 2003/0016258 A1 Jan. 23, 2003

(51) Int. Cl.[7] ..... B41J 29/38
(52) U.S. Cl. ..... 347/14; 347/11
(58) Field of Search ..... 347/9–11, 12, 347/14, 144, 184, 196; 346/1.1, 140 R

(56) References Cited

U.S. PATENT DOCUMENTS

| | | | | |
|---|---|---|---|---|
| 5,107,276 A | | 4/1992 | Kneezel et al. | |
| 5,321,427 A | * | 6/1994 | Agar et al. | 347/14 |
| 5,497,174 A | | 3/1996 | Stephany et al. | |
| 5,677,577 A | | 10/1997 | Barbehenn et al. | |
| 5,682,185 A | | 10/1997 | Wade et al. | |
| 5,742,307 A | | 4/1998 | Watrobski et al. | |
| 5,751,302 A | | 5/1998 | Rezanka | |
| 5,841,449 A | | 11/1998 | Silverbrook | |
| 5,844,581 A | | 12/1998 | DeJoseph et al. | |
| 5,864,351 A | | 1/1999 | Silverbrook | |
| 5,920,331 A | | 7/1999 | Silverbrook | |
| 6,116,714 A | | 9/2000 | Imanaka et al. | |

* cited by examiner

*Primary Examiner*—John Barlow
*Assistant Examiner*—An H. Do
(74) *Attorney, Agent, or Firm*—David LaRose; Jacqueline M. Daspit

(57) ABSTRACT

A thermal ink jet printing apparatus maintains stable printing output as certain characteristics of the apparatus change over its operational lifetime. The apparatus includes an ink jet print head with resistive heating elements for receiving electrical energy pulses having a voltage level and for transferring heat energy pulses having a desired energy level into adjacent ink based on the electrical energy pulses. The print head includes nozzles associated with the resistive heating elements through which droplets of the ink are ejected when the heat energy pulses are transferred into the ink. The apparatus further includes a printer controller in electrical communication with the print head. The printer controller determines a pulse count indicative of a number of electrical energy pulses, applies the electrical energy pulses having a first pulse width to the resistive heating elements when the pulse count is less than a threshold value, and applies the electrical energy pulses having an adjusted pulse width to the resistive heating elements when the pulse count exceeds the threshold value. The difference in the first and the adjusted pulse widths compensates for changes in the electrical resistance of the resistive heating elements over time.

26 Claims, 6 Drawing Sheets

LONG-LIFE STABLE-JETTING THERMAL INK JET PRINTER

FIELD OF THE INVENTION

The present invention is generally directed to thermal ink jet printing. More particularly, the invention is directed to a method and apparatus for maintaining desired levels of heat energy transferred into ink to form ink droplets as characteristics of an ink jet print head change over its operational lifetime.

BACKGROUND OF THE INVENTION

Generally, thermal ink jet print head chips consist of several thin film layers, including a resistor layer, conductor layer, dielectric layer, and protection layer. When electrical current is passed through a resistive heating element formed in the resistor layer, ink adjacent to the heating element is superheated and forms a bubble that causes an ink droplet to be expelled from an adjacent nozzle.

Many thermal ink jet print heads incorporate a tantalum aluminum (TaAl) thin film as the resistor layer in which the resistive heating elements are formed. Over time, a TaAl thin film experiences material degradation due to current and temperature stressing as electrical current pulses are applied to the heating elements. The material degradation mechanisms include aluminum segregation from the TaAl film, recrystallization of the TaAl under high temperatures, and electromigration of aluminum from the TaAl film. This degradation causes a gradual decrease in the electrical resistance of the heating elements over time.

Many current ink jet printers apply one voltage level (rail voltage) to the resistive heating elements to pass electrical current through the elements, and this voltage level is not changed over the lifetime of a print head. With a constant rail voltage, any decrease in heating element resistance, such as by material degradation, causes a corresponding increase in the current flowing through the heating elements. An increase in current causes a corresponding increase in the heat energy generated by the heating elements, and an increase in the temperature at the surface of the heating elements. If surface temperatures rise too high, extensive ink kogation may occur at the surface of the heating elements. Also, increased current levels cause even greater electromigration or segregation of the aluminum in the TaAl film, which is further detrimental to heater reliability.

Therefore, a system is needed for maintaining stable heat energy levels at the surfaces of the resistive heating elements over the operational lifetime of an ink jet print head.

SUMMARY OF THE INVENTION

The foregoing and other needs are met by a method of operating a thermal ink jet print head having nozzles through which ink is ejected when energy pulses having a desired pulse energy are applied to resistive heating elements associated with the nozzles. Each of the resistive heating elements has a heater resistance which tends to change over the operational lifetime of the print head. The method provides stable ink ejecting characteristics over the lifetime of the print head by compensating for the change in heater resistance. The method includes applying energy pulses having a first pulse width to the resistive heating elements, and counting the energy pulses to determine a pulse count. When the pulse count exceeds a threshold value, pulses having an adjusted pulse width are applied to the resistive heating elements, where the adjusted pulse width accounts for the changes in the heater resistance during the operational lifetime of the print head.

Preferred embodiments of the method include accessing a total print head resistance value which is based at least in part upon the heater resistance and resistances of circuit components in series with the resistive heating elements, accessing a heater resistance value related to the heater resistance, accessing a print head voltage value, accessing a first pulse energy value related to the desired pulse energy, and determining the first pulse width based upon the heater resistance value, the total print head resistance value, the print head voltage value, and the first pulse energy value. Preferred embodiments further include accessing a second pulse energy value related to the desired pulse energy and determining the adjusted pulse width based upon the heater resistance value, the total print head resistance value, the print head voltage value, and the second pulse energy value.

In another aspect, the invention provides a thermal ink jet printing apparatus for maintaining stable printing characteristics. The apparatus includes an ink jet print head having resistive heating elements for receiving electrical energy pulses having a voltage level and for transferring heat energy pulses having a desired energy level into adjacent ink based on the electrical energy pulses. The print head includes nozzles associated with the resistive heating elements through which droplets of the ink are ejected when the heat energy pulses are transferred into the ink. The apparatus further includes a printer controller in electrical communication with the print head. The printer controller determines a pulse count indicative of a number of electrical energy pulses, applies the electrical energy pulses having a first pulse width to the resistive heating elements when the pulse count is less than a threshold value, and applies the electrical energy pulses having an adjusted pulse width to the resistive heating elements when the pulse count exceeds the threshold value. The differences in the first and the adjusted pulse widths compensate for changes in the electrical resistance of the resistive heating elements over the operational lifetime of the print head.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
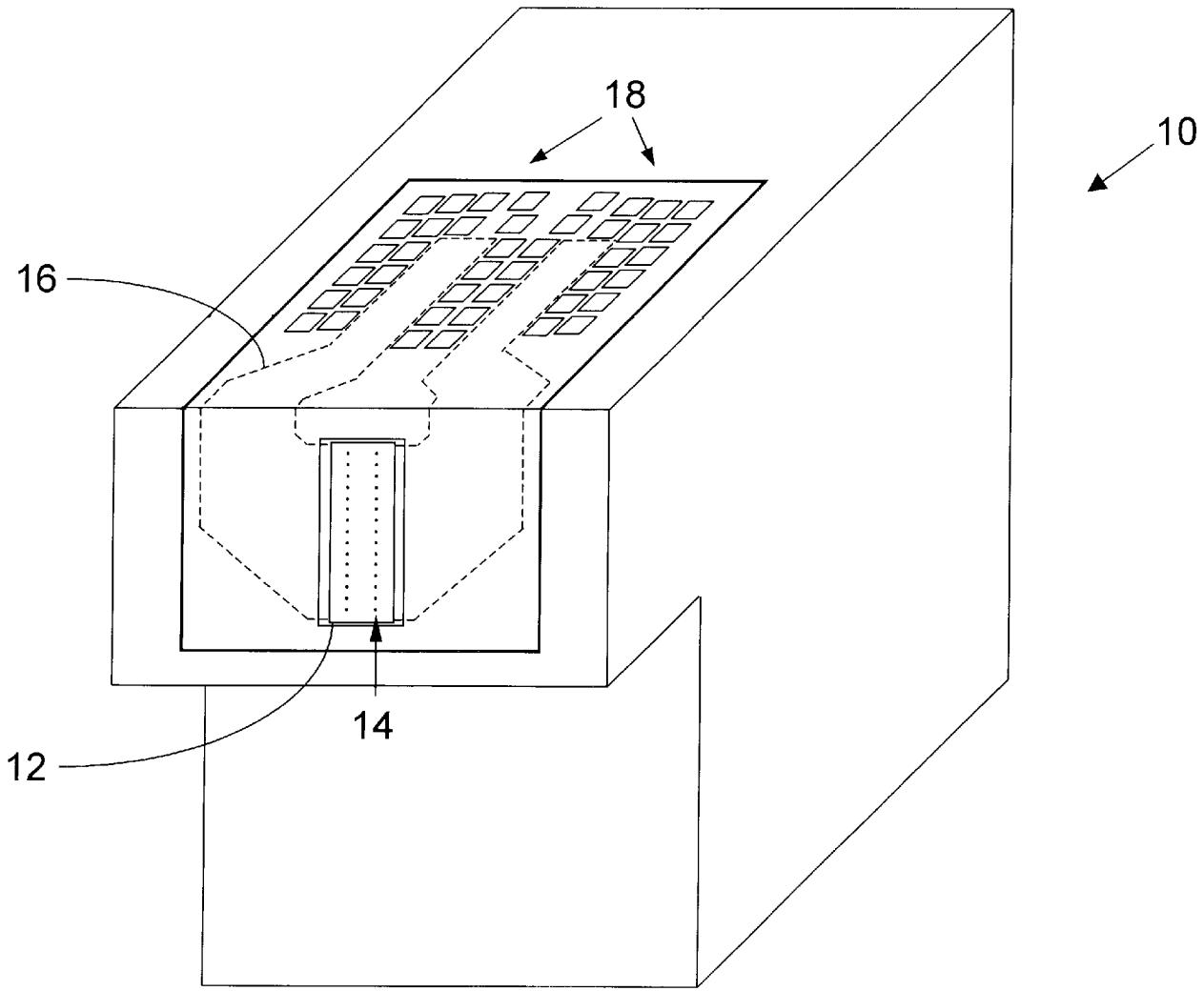
FIG. 1 depicts a thermal ink jet print head according to a preferred embodiment of the invention.

FIG. 1 depicts an ink jet print head 10, such as may be used in a thermal ink jet printer. The print head 10 includes an integrated circuit chip, also referred to herein as an ink jet heater chip 12 which, as described in more detail below, contains resistive heating elements, driver circuits, logic devices, and memory devices. An array of nozzles 14 are provided on the print head 10 through which droplets of ink are selectively ejected when corresponding heating elements in the heater chip 12 are activated. On the print head 10 are a set of electrical contacts 18 which make connection with a corresponding set of contacts in the printer when the print head 10 is installed in the printer. Electrical traces provided in the dashed-outline region 16 connect the contacts 18 to the heater chip 12.

Figure 2:
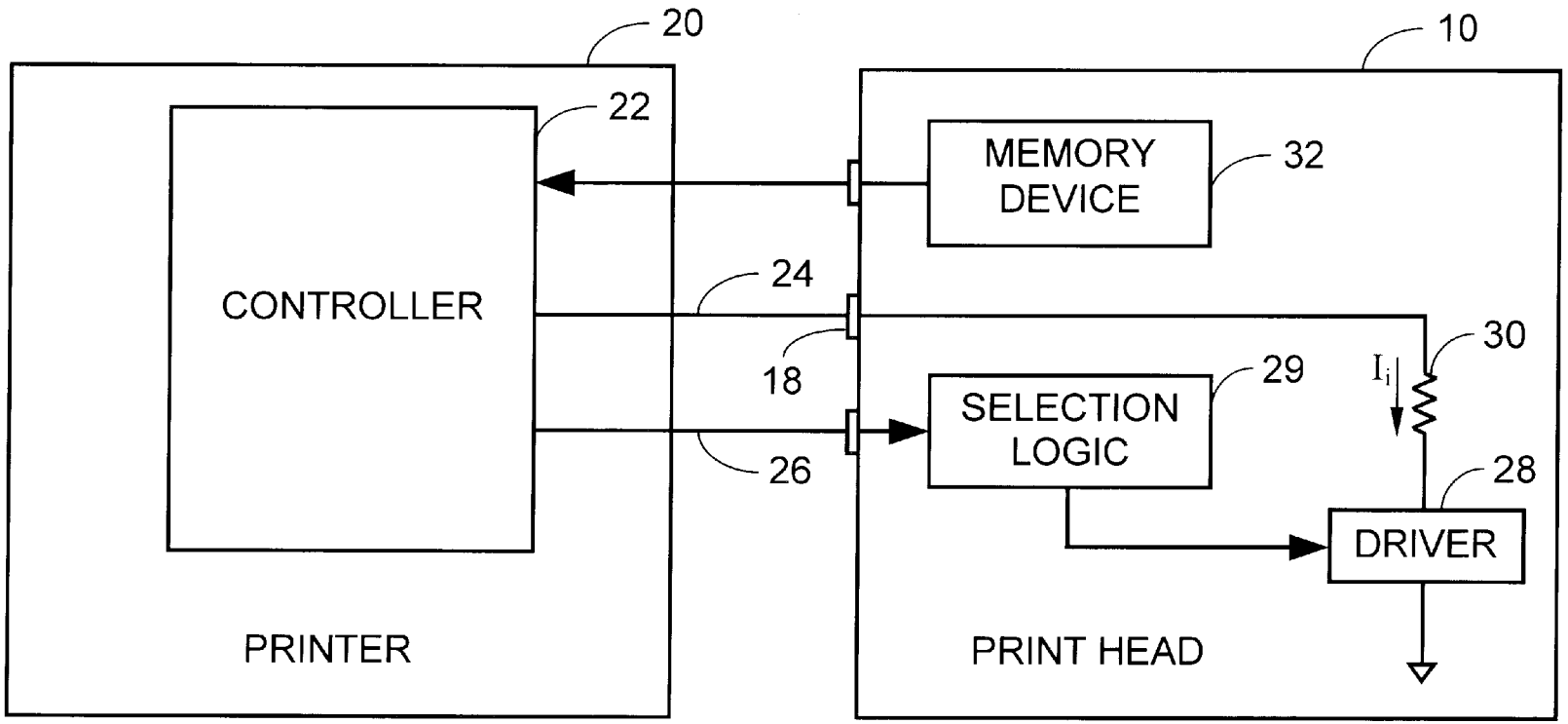
FIG. 2 is a functional block diagram of a thermal ink jet print head connected to a printer controller according to a preferred embodiment of the invention.

Shown in FIG. 2 is a functional block diagram of the print head 10 connected to a printer 20. Within the printer 20 is a microprocessor controller 22 that provides print control signals to the print head 10 based on print data from a host computer. The print control signals include a print head voltage signal, also referred to herein as a rail voltage, on the line 24, and an encoded nozzle selection or address signal on the line 26. Preferably, the rail voltage on the line 24 is provided as a pulsed signal, having a voltage amplitude in the 7–11 volt range, and having a pulse width in the 0.5 to 3.0 $\mu$s range. As described in more detail hereinafter, the invention sets the pulse width of the rail voltage pulses to provide an optimum energy density on the surface of the heating elements of the print head 10.

As depicted in FIG. 2, the line 24 provides the rail voltage to a driver 28, such as a MOSFET device, which acts as a switch. The on/off state of the driver 28 is determined, at least in part, upon a selection signal from a selection logic circuit 29. If the driver 28 is "on", a current $I_i$ flows through a heating element 30 and through the driver 28 which is in series with the heating element 30. The heating element 30 of the preferred embodiment is constructed from a tantalum aluminum (TaAl) thin film, and has an electrical resistance referred to herein as $R_H$. Due to the resistance $R_H$, the current $I_i$ flowing through the heating element 30 generates heat energy on the surface of the heating element 30. This heat energy is transferred into ink adjacent the heating element 30, thereby causing the ink to nucleate and force a droplet of ink outward through an associated one of the nozzles in the nozzle array 14.

The number of drivers and heating elements on a heater chip of a print head is typically in the hundreds. However, to avoid unduly complicating FIG. 2, only one driver 28 and one heating element 30 are depicted. One skilled in the art will appreciate that the present invention is applicable to a print head having any number of heating elements.

Figure 3:
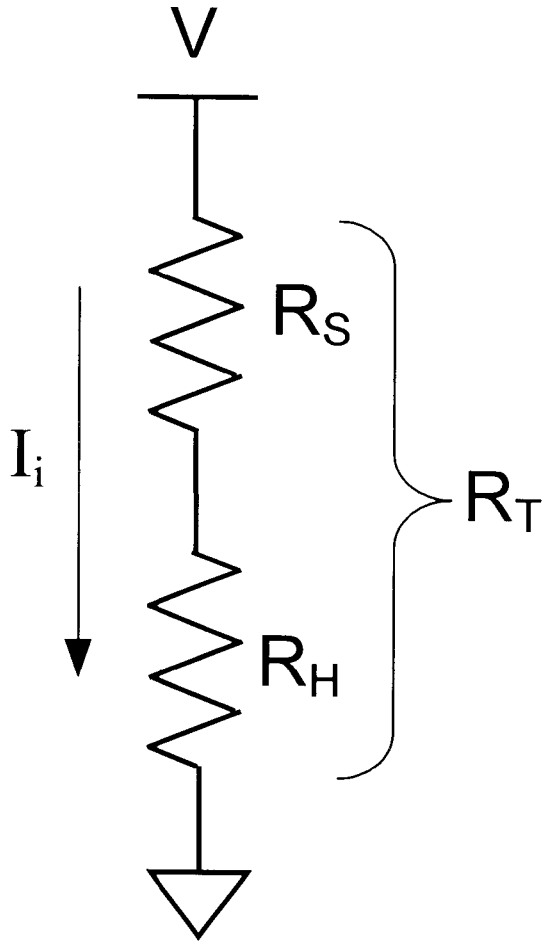
FIG. 3 depicts the application of a rail voltage to print head resistances according to a preferred embodiment of the invention.

The driver 28, the line 24, and the contacts 18 introduce resistance in series with the heating element 30. This series resistance, as depicted in FIG. 3, is referred to herein as $R_s$. The sum of $R_s$ and $R_H$ is referred to herein as the total resistance $R_T$. The current $I_i$ flowing through the heating element 30 is expressed as:

$$I_i = \frac{V}{R_T}, \quad \text{where } V \text{ is the rail voltage.} \tag{1}$$

The heat energy at the surface of the heating element 30 produced by a pulse of the current $I_i$ may be expressed as:

$$E_p = T_p \times I_i^2 \times R_H, \tag{2}$$

where $E_p$ is the heat energy produced by the current pulse and $T_p$ is the pulse width.

This relationship may also be expressed as:

$$E_p = T_p \times \left(\frac{V}{R_T}\right)^2 \times R_H = T_p \times \left(\frac{V}{R_H + R_S}\right)^2 \times R_H. \tag{3}$$

As equation (3) indicates, if the resistance $R_H$ were to decrease over time, such as due to material degradation of the TaAl thin film, the pulse heat energy $E_p$ would increase. During design of the print head 10, the resistance $R_H$, the voltage V, and the pulse width $T_p$ are set to provide an optimum energy density on the surface of the heating element 30. This optimum energy density is preferably high enough to cause nucleation of the ink to form an ink droplet moving at a desired velocity, but not so high as to cause kogation, or scalding, of the ink at the surface of the heating element 30. Significant kogation impedes heat transfer and causes degradation in print quality. Thus, a significant decrease in the resistance $R_H$ leads to degradation in print quality if no compensation is provided to reduce the energy density at the surface of the heating element 30. As discussed in more detail hereinafter, the present invention provides this needed compensation by adjusting the pulse width $T_p$ to account for changes in the resistance $R_H$ over time.

As shown in FIG. 2, the print head 10 includes a non-volatile memory device 32, such as an EEPROM device, for storing values related to the pulse width $T_p$. In the preferred embodiment of the invention, the memory device 32 stores a value for the rail voltage V, a value for the initial heater resistance $R_H$, a value for the total resistance $R_T$, a value for a pulse count, a value for a pulse count threshold, and values related to an initial pulse energy $E_1$ and an adjusted pulse energy $E_2$. As described below, the controller 22 accesses the memory device 32 to retrieve one or more of these values, and calculates an optimum pulse width based thereon.

Figure 4A:
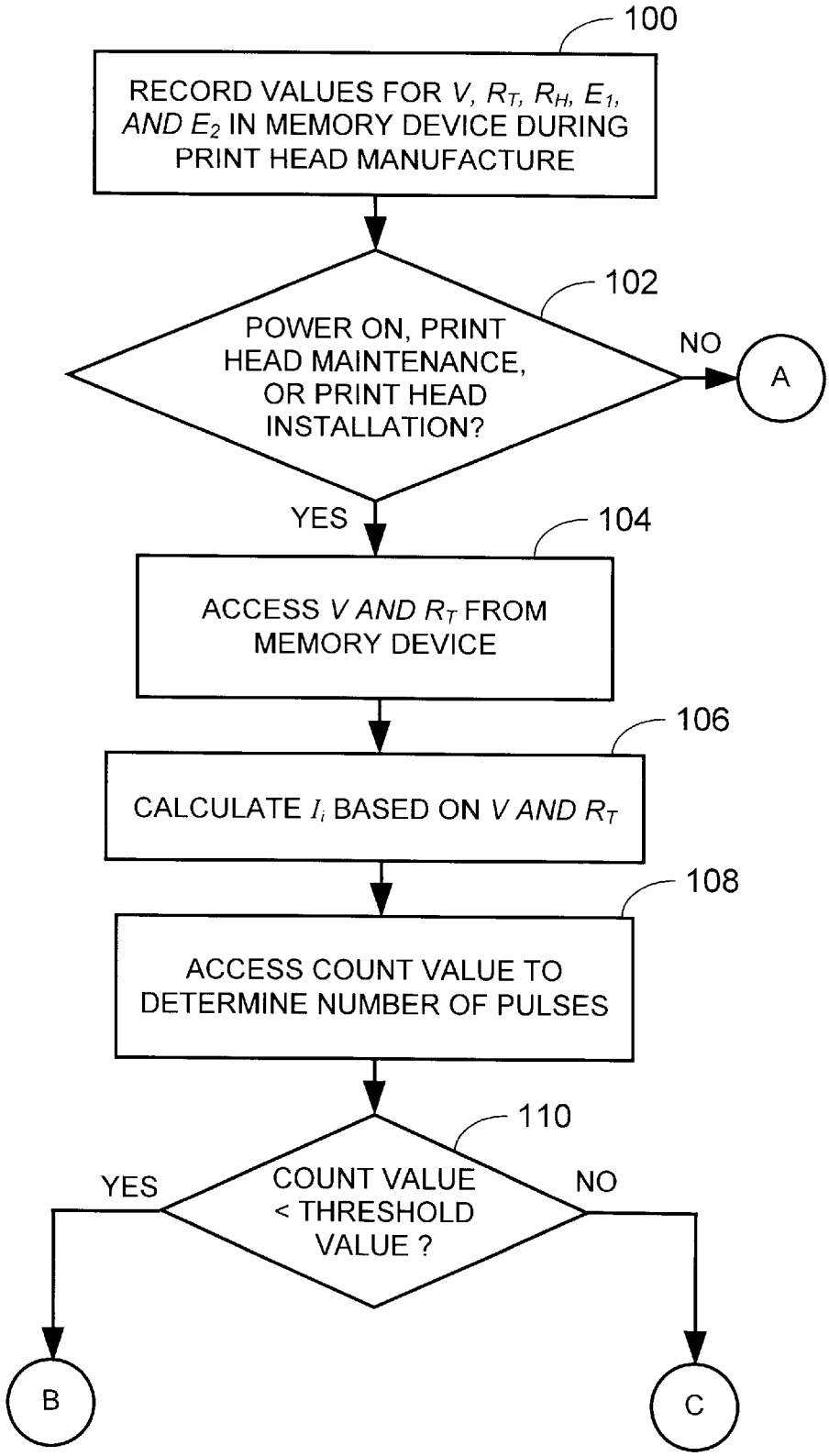
FIGS. 4A and 4B depict a functional flow diagram of a preferred method for adjusting the pulse width of ink-firing pulses in an ink jet print head.
Figure 4B:
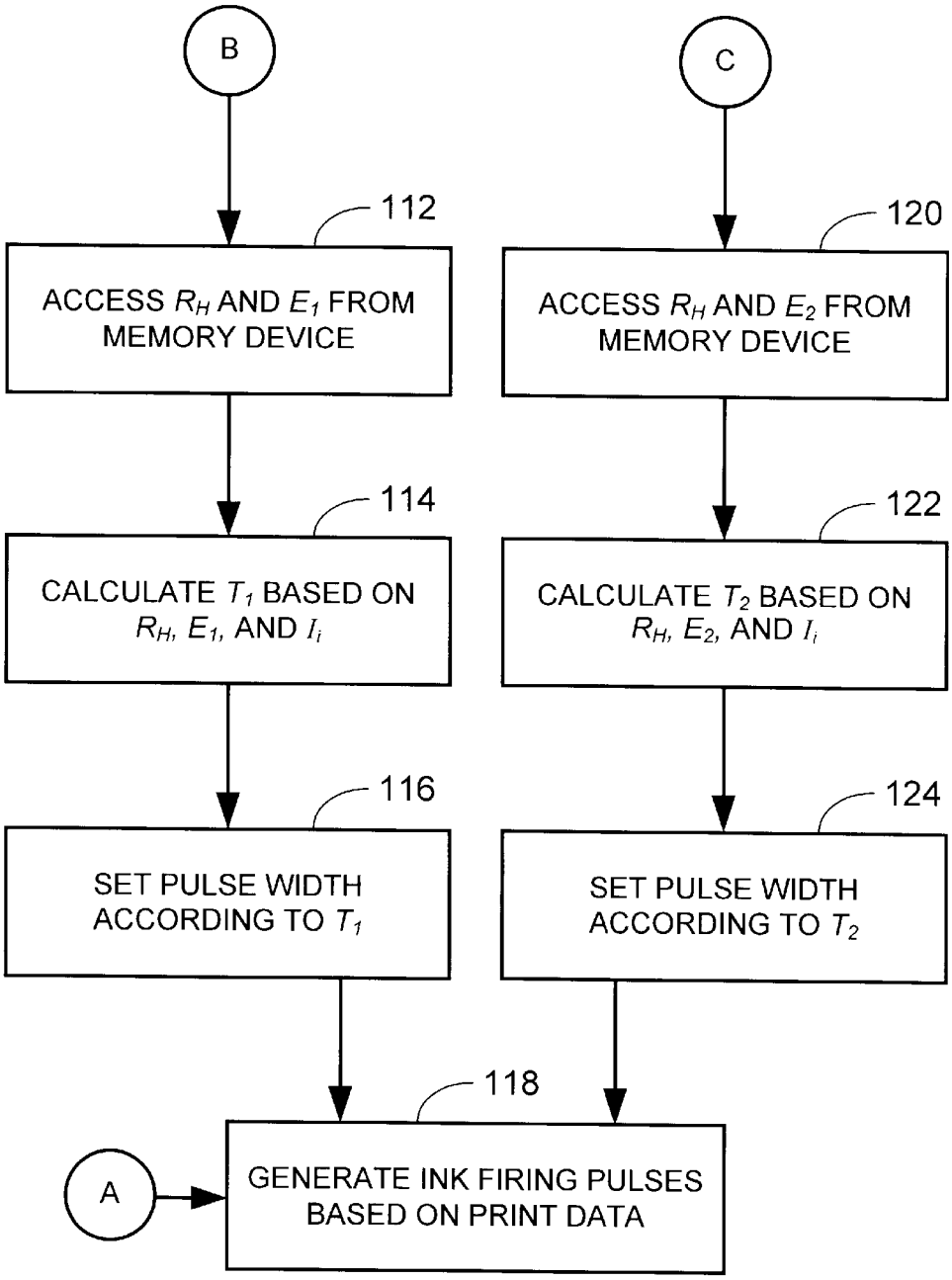
Figure 5:
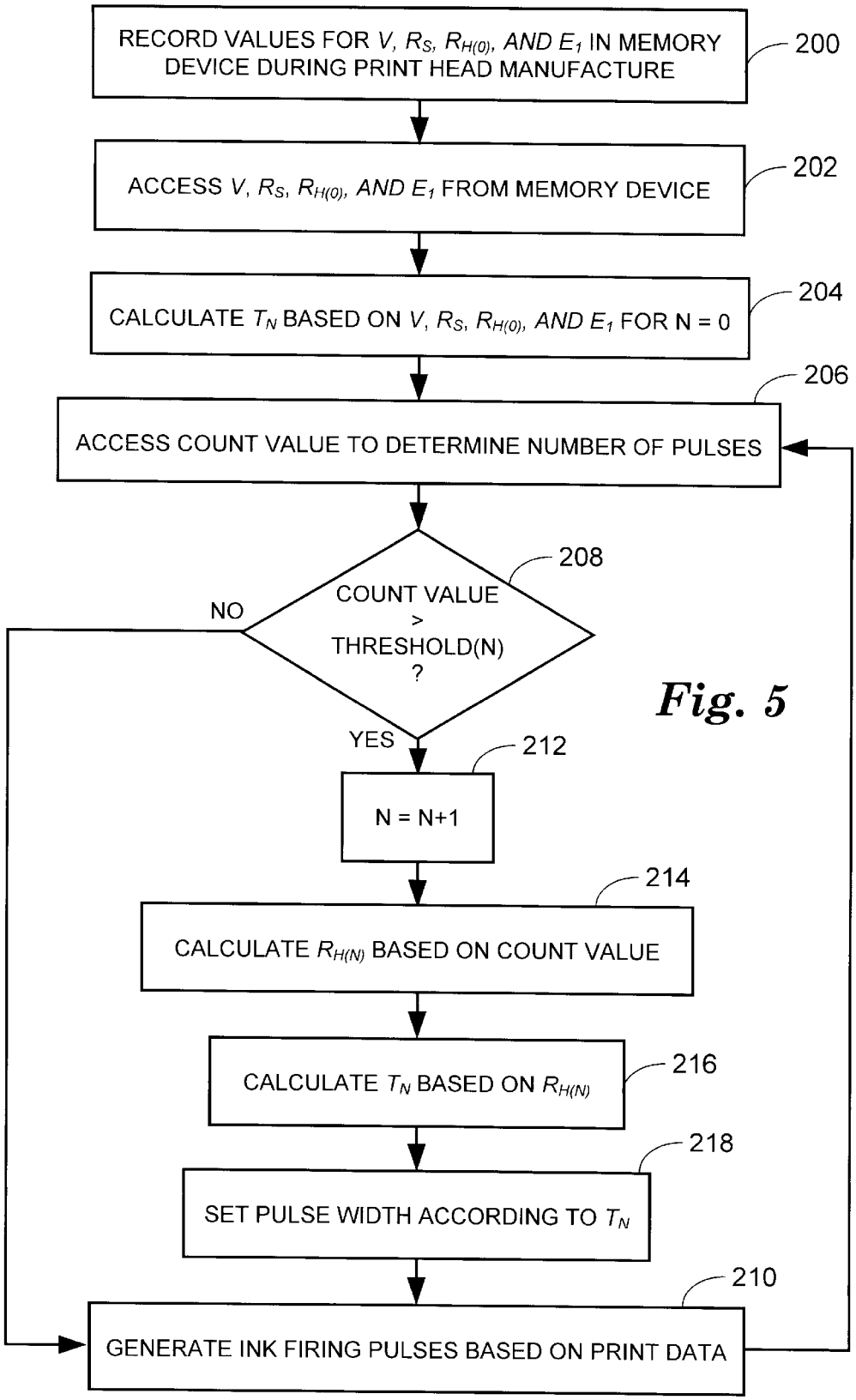
FIG. 5 depicts a functional flow diagram of an alternative method for adjusting the pulse width of ink-firing pulses in an ink jet print head.

Depicted in FIGS. 4A and 4B is a process for implementing a one-time adjustment in the pulse width $T_p$ to compensate for changes in the resistance $R_H$ over the operational lifetime of the ink jet print head 10. The process is preferably begun during the manufacture of the ink jet print head 10 by recording in the memory device 32 the values related to print head characteristics which will be used in determining an optimum pulse width for the ink-firing pulses (step 100). In the preferred embodiment, these values include the rail voltage V, the initial heater resistance $R_H$, and the total resistance $R_T$, each of which is preferably measured during testing stages of the print head assembly process. Predetermined values related to the initial pulse energy $E_1$ and the adjusted pulse energy $E_2$ are also stored in the memory device 32. The initial pulse energy value E, represents the desired value of heat energy generated by the heating element 30. The adjusted pulse energy value $E_2$ represents a change in energy to account for the expected change in heating element resistance $R_H$ after a predetermined number of firing pulses.

In the preferred embodiment, the process for adjusting the pulse width is carried out when the printer 20 is powered on, when a print head maintenance routine is performed, or when a new print head 10 is installed in the printer 20. If any one of these events occurs (step 102), the printer controller 22 accesses the rail voltage value V and the total resistance value $R_T$ from the print head memory device 32 (step 104), and calculates the initial current value $I_i$, preferably based on equation (1) (step 106).

During the operational lifetime of the print head 10, a running count is kept of the number of ink-firing pulses generated by the print head 10. Preferably, since this pulse count value is associated with a particular print head 10, it is stored in the print head memory device 32. Alternatively, the pulse count value may be stored in memory in the printer 20. The controller 22 accesses the pulse count value and determines based thereon how many ink-firing pulses have been generated by the installed print head 10 (step 108). The subsequent steps in the process are determined by whether the pulse count exceeds a predetermined threshold value.

Experiments conducted on a particular print head manufactured by the assignee of this invention have indicated that about 50% of the reduction in the heating element resistance $R_H$ due to thin film material degradation occurs prior to the pulse count reaching about 7.5 million. Thus, in the most preferred embodiment of the invention, the threshold value is about 7.5 million. However, it should be appreciated that the rate of change in heating element resistance $R_H$ may vary from one print head design to the next, such that different threshold values may be selected based upon characteristics that vary from one print head design to the next. Thus, it should be appreciated that the invention is not limited to any particular threshold value.

As depicted in FIGS. 4A and 4B, if the controller 22 determines that the pulse count value is less than the threshold value (step 110), the controller 22 accesses the heating element resistance value $R_H$ and the initial pulse energy value $E_1$ from the print head memory device 32 (step 112). In the preferred embodiment, the controller 22 then calculates an initial or first pulse width value $T_1$ according to:

$$T_1 = \frac{E_1}{I_i^2 \times R_H} \text{ (step 114).} \tag{4}$$

The controller 22 then sets the pulse width of the ink-firing pulses on the line 26 according to the value $T_1$ (step 116). The pulse width $T_1$ is preferably maintained in generating ink-firing pulses (step 118) for all subsequent printing operations which take place prior to the next occurrence of any one of the conditions of step 102.

If the controller 22 determines at step 110 that the pulse count value is greater than the threshold value, the controller 22 accesses the heating element resistance value $R_H$ and the adjusted pulse energy value $E_2$ from the print head memory device 32 (step 120). In the preferred embodiment, the controller 22 then calculates an adjusted or second pulse width value $T_2$ according to:

$$T_2 = \frac{E_2}{I_i^2 \times R_H} \text{ (step 122).} \tag{5}$$

The controller 22 then sets the pulse width of the ink-firing pulses on the line 26 according to the value $T_2$ (step 124). In this embodiment of the invention, the adjusted pulse width $T_2$ is preferably maintained in generating ink-firing pulses (step 118) for all subsequent printing operations during the lifetime of the print head 10.

As described above, the preferred embodiment of the invention stores several values in the memory 32 related to the initial measured resistances and rail voltage, the calculated initial current, the pulse count, the pulse count threshold value, and the initial and adjusted energy levels, and uses these stored values to calculate initial and adjusted pulse widths. In an alternative embodiment of the invention, only pulse width values are stored, such as an initial pulse width value to be used when the pulse count is less than a threshold value, and an adjusted pulse width value to be used when the pulse count is greater than a threshold value. For example, the initial pulse width value $T_1$ may be determined during the manufacture of the print head according to:

$$T_1 = \frac{E_1 \times (R_S + R_H)^2}{V^2 \times R_H}, \tag{6}$$

where V, $R_s$, and $R_H$ are measured values as described above, and $E_1$ is the desired pulse energy to be maintained throughout the lifetime of the print head 10. Similarly, the adjusted pulse width $T_2$ is determined and stored during the manufacture of the print head according to:

$$T_2 = \frac{E_1 \times (R_S + R_2)^2}{V^2 \times R_2}, \tag{7}$$

where $R_2$ is the predicted heating element resistance value after the pulse count exceeds the threshold value.

In one embodiment of the invention, multiple pulse width adjustments are made during the lifetime of the print head 10 to compensate for changes in the heating element resistance $R_H$. In this embodiment, N number of count threshold values are stored in memory, either in the print head memory 32 or in memory associated with the printer controller 22. As described in more detail below, the pulse width of the ink firing pulses is adjusted in a number of steps as the pulse count exceeds a corresponding number of count threshold values.

As with the previously-described embodiments, the process of this embodiment is preferably begun during the manufacture of the ink jet print head 10 by recording in the memory device 32 values related to print head characteristics that are used in determining an optimum pulse width for the ink-firing pulses (step 200). These values preferably include the rail voltage V, the initial heater resistance $R_{H(1)}$, the series resistance $R_s$, and the desired pulse energy value $E_1$. The printer controller 22 accesses these stored values (step 202) and calculates an initial pulse width $T_N$ (for adjustment step N=1) based on the following expression:

$$T_N = \frac{E_1 \times (R_S + R_{H(N)})^2}{V^2 \times R_{H(N)}} \text{ (step 204).} \tag{8}$$

The controller 22 accesses the pulse count value from the print head memory device 32 or from memory associated with the controller 22, and determines based thereon how many ink-firing pulses have been generated by the print head 10 up to that point in the print head lifetime (step 206). The controller 22 accesses the pulse count threshold, also referred to as $THRSHLD_N$, (where N =1) and determines whether the count value exceeds $THRSHLD_N$. If not, the initial pulse width is maintained in generating the ink-firing pulses (step 210).

If the pulse count exceeds $THRSHLD_N$, then N is incremented by one (step 212), and a new heating element resistance value $R_{H(N)}$ is calculated. Preferably, the new resistance value is calculated (step 214) according to:

$$R_{H(N)} = R_{H(1)} - \Delta R_H, \tag{9}$$

where $\Delta R_H$ is a resistance change value calculated according to:

$$\Delta R_H = R_{H(1)} \times [A + B \times \log(PC)]. \tag{10}$$

In equation (10), A and B are experimentally-determined constants, and PC is the current pulse count.

Based on the new resistance value $R_{H(N)}$, the controller 22 calculates an adjusted pulse width value $T_{N^*}$ according to:

$$T_{N^*} = \frac{T_{N-1}}{2} + \frac{E_1 \times (R_S + R_{H(N)})^2}{2 \times V^2 \times R_{H(N)}} \text{ (step 216)}, \quad (11)$$

and sets the pulse width accordingly (step 218). The newly-adjusted pulse width value $T_{N^*}$ is used in generating the ink-firing pulses while the pulse count value is between the pulse count thresholds $THRSHLD_N$ and $THRSHLD_{N-1}$. For this embodiment, the number of adjustment steps and the pulse count threshold values $THRSHLD_N$ are determined based on characteristics of the particular print head 10 to provide the optimum print quality over the lifetime of the print head 10.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A method of operating a thermal ink jet print head having nozzles through which ink is ejected when energy pulses having a desired pulse energy are applied to resistive heating elements associated with the nozzles, each of the resistive heating elements having a heater resistance, the method comprising:

(a) applying the energy pulses having a first pulse width to the resistive heating elements;

(b) counting the energy pulses to determine a pulse count; and (c) when the pulse count exceeds a threshold value, applying to the resistive heating elements pulses having an adjusted pulse width which is different from the first pulse width, where the adjusted pulse width compensates for changes in the heater resistance over time, thereby providing stable ink ejecting characteristics.

2. The method of claim 1 wherein step (a) further comprises:

(a1) accessing a total print head resistance value which is based at least in part upon the heater resistance and resistances of circuit components in series with the resistive heating elements;

(a2) accessing a heater resistance value related to the heater resistance;

(a3) accessing a print head voltage value;

(a4) accessing a first pulse energy value related to the desired pulse energy; and (a5) determining a first pulse width value related to the first pulse width, the first pulse width value based at least in part upon the heater resistance value, the total print head resistance value, the print head voltage value, and the first pulse energy value.

3. The method of claim 2 wherein step (a5) further comprises:

determining an initial current value according to:

$$I_i = \frac{V}{R_T},$$

where $I_i$ is the initial current value, V is the print head voltage value, and $R_T$ is the total print head resistance value; and determining the first pulse width value according to:

$$T_1 = \frac{E_1}{I_i^2 \times R_H},$$

where $T_1$ is the first pulse width value, $E_1$ is the first pulse energy value, and $R_H$ is the heater resistance value.

4. The method of claim 2 wherein step (a5) further comprises determining the first pulse width value according to:

$$T_1 = \frac{E_1 \times (R_T)^2}{V^2 \times R_H},$$

where $T_1$ is the first pulse width value, $E_1$ is the first pulse energy value, V is the print head voltage value, $R_T$ is the total print head resistance value, and $R_H$ is the heater resistance value.

5. The method of claim 2 wherein step (c) further comprises:

(c1) accessing a second pulse energy value related to the desired pulse energy; and (c2) determining an adjusted pulse width value related to the adjusted pulse width, the adjusted pulse width value based at least in part upon the heater resistance value, the total print head resistance value, the print head voltage value, and the second pulse energy value.

6. The method of claim 5 wherein step (c2) further comprises:

determining an initial current value according to:

$$I_i = \frac{V}{R_T},$$

where $I_i$ is the initial current value, V is the print head voltage value, and $R_T$ is the total print head resistance value; and determining the adjusted pulse width value according to:

$$T_2 = \frac{E_2}{I_i^2 \times R_H},$$

where $T_2$ is the adjusted pulse width value, $E_2$ is the second pulse energy value, and $R_H$ is the heater resistance value.

7. The method of claim 5 wherein step (c2) further comprises determining the adjusted pulse width value according to:

$$T_2 = \frac{E_2 \times (R_T)^2}{V^2 \times R_H},$$

where $T_2$ is the adjusted pulse width value, $E_2$ is the second pulse energy value, V is the print head voltage value, $R_T$ is the total print head resistance value, and $R_H$ is the heater resistance value.

8. The method of claim 1 wherein step (a) further comprises:

(a1) accessing a first pulse width value from a memory device; and (a2) determining the first pulse width based upon the first pulse width value.

9. The method of claim 1 wherein step (c) further comprises:

(c1) accessing a second pulse width value from a memory device; and (c2) determining the adjusted pulse width based upon the second pulse width value.

10. The method of claim 1 wherein:

step (b) further comprises storing the pulse count value in a memory device on the print head; and step (c) further comprises accessing the threshold value from the memory device.

11. The method of claim 1 further comprising repeating steps (b) and (c) N number of times corresponding to N number of pulse width adjustment steps.

12. A method of operating a thermal ink jet print head having nozzles through which ink is ejected when energy pulses are applied to resistive heating elements associated with the nozzles, the resistive heating elements having a heater resistance, the method comprising:

(a) determining a pulse count indicative of a number of pulses applied to one or more of the resistive heating elements;

(b) when the pulse count is less than a threshold value, applying the energy pulses having a first pulse width to the resistive heating elements; and (c) when the pulse count exceeds the threshold value, applying the energy pulses having an adjusted pulse width to the resistive heating elements, where the adjusted pulse width compensates for changes in the heater resistance over time, thereby providing stable ink ejecting characteristics.

13. The method of claim 12 wherein step (b) further comprises:

(b1) accessing a total print head resistance value which is based at least in part upon the heater resistance and resistances of circuit components in series with the resistive heating elements;

(b2) accessing a print head voltage value;

(b3) accessing a first pulse energy value; and (b4) determining a first pulse width value related to the first pulse width, the first pulse width value based at least in part upon the heater resistance, the total print head resistance value, the print head voltage value, and the first pulse energy value.

14. The method of claim 12 wherein step (c) further comprises:

(c1) accessing a total print head resistance value which is based at least in part upon the heater resistance and resistances of circuit components in series with the resistive heating elements;

(c2) accessing a print head voltage value;

(c3) accessing a second pulse energy value; and (c4) determining an adjusted pulse width value related to the adjusted pulse width, the adjusted pulse width value based at least in part upon the heater resistance value, the total print head resistance value, the print head voltage value, and the second pulse energy value.

15. The method of claim 12 further comprising accessing the pulse count value and the threshold value from a memory device on the print head.

16. A method of operating a thermal ink jet print head having nozzles through which ink is ejected when energy pulses having a desired pulse energy are applied to resistive heating elements associated with the nozzles, the resistive heating elements each having an initial heater resistance, the print head having a total print head resistance which includes a series combination of the initial heater resistance and resistances of circuit components in series with the resistive heating elements, the method comprising:

(a) applying the energy pulses having an initial pulse width to the resistive heating elements;

(b) counting the energy pulses to determine a pulse count;

(c) when the pulse count reaches a threshold value, determining a resistance change value related to a change in at least the initial heater resistance;

(d) determining an adjusted pulse width based at least in part upon the resistance change value, where the adjusted pulse width is less than the initial pulse width; and (e) applying the energy pulses having the adjusted pulse width to the resistive heating elements, where the adjusted pulse width compensates for changes in the initial heater resistance over time, thereby providing stable ink ejecting characteristics.

17. The method of claim 16, wherein step (c) further comprises determining a reduction in heater resistance according to:

$$\Delta R_H = R_H \times [A + B \times \log(PC)],$$

where $R_H$ is the initial heater resistance, $\Delta R_H$ is the reduction in heater resistance, A and B are experimentally-determined constants, and PC is the pulse count.

18. The method of claim 16 further comprising repeating steps (b) through (e) N number of times corresponding to N number of pulse width adjustment steps.

19. The method of claim 18, wherein step (d) further comprises determining the adjusted pulse width according to:

$$T_N = \frac{E_1 \times (R_S + R_{H(N)})^2}{V^2 \times R_{H(N)}},$$

where $T_N$ is the adjusted pulse width, $E_1$ is the desired pulse energy, V is a print head voltage, $R_S$ is the resistance of the circuit components in series with the resistive heating elements, and $R_{H(N)}$ is the heater resistance corresponding to the pulse count.

20. The method of claim 16 wherein:

step (b) further comprises storing the pulse count value in a memory device on the print head; and step (c) further comprises accessing the threshold value from the memory device.

21. A thermal ink jet printing apparatus comprising:

an ink jet print head including:

resistive heating elements having an electrical resistance, the resistive heating elements for receiving electrical energy pulses having a voltage level and for transferring heat energy pulses having a desired energy level into adjacent ink based on the electrical energy pulses; and nozzles associated with the resistive heating elements through which droplets of the ink are ejected when the heat energy pulses are transferred into the ink;

a printer controller in electrical communication with the print head, the printer controller for determining a pulse count indicative of a number of electrical energy pulses, for applying the electrical energy pulses having a first pulse width to the resistive heating elements when the pulse count is less than a threshold value, and for applying the electrical energy pulses having an adjusted pulse width to the resistive heating elements when the pulse count exceeds the threshold value, where differences in the first pulse width and the adjusted pulse width compensate for changes in the electrical resistance of the resistive heating elements over time, thereby maintaining stable printing characteristics over time.

22. The apparatus of claim 21 further comprising:

one or more memory devices for storing one or more values related to the desired energy level of the heat energy pulses transferred to the ink, the one or more values including at least a first pulse energy value; and the printer controller further for accessing the first pulse energy value from the one or more memory devices, and for determining the first pulse width based at least in part upon the first pulse energy value.

23. The apparatus of claim 22 further comprising:

the one or more memory devices further for storing a print head voltage value, a total print head resistance value, and a heater resistance value; and the printer controller for determining the first pulse width according to:

$$T_1 = \frac{E_1 \times (R_T)^2}{V^2 \times R_H},$$

where $T_1$ is the first pulse width, $E_1$ is the first pulse energy value, V is the print head voltage value, $R_T$ is the total print head resistance value, and $R_H$ is the heater resistance value.

24. The apparatus of claim 22 further comprising:

the one or more memory devices for storing a second pulse energy value; and the printer controller further for accessing the second pulse energy value from the one or more memory devices, and for determining the adjusted pulse width based at least in part upon the second pulse energy value.

25. The apparatus of claim 24 further comprising:

the one or more memory devices further for storing a print head voltage value, a total print head resistance value, and a heater resistance value; and the printer controller for determining the adjusted pulse width according to:

$$T_2 = \frac{E_2 \times (R_T)^2}{V^2 \times R_H},$$

where $T_2$ is the adjusted pulse width, $E_2$ is the second pulse energy value, V is the print head voltage value, $R_T$ is the total print head resistance value, and $R_H$ is the heater resistance value.

26. A thermal ink jet printing apparatus comprising:

an ink jet print head including:

resistive heating elements having an electrical resistance, the resistive heating elements for receiving electrical energy pulses having a voltage level and for transferring heat energy pulses having a desired energy level into adjacent ink based on the electrical energy pulses;

nozzles associated with the resistive heating elements through which droplets of the ink are ejected when the heat energy pulses are transferred into the ink;

one or more memory devices for storing one or more values related to the desired energy level of the heat energy pulses transferred to the ink, the one or more values including a first pulse energy value, a second pulse energy value, a print head voltage value, a total print head resistance value, and a heater resistance value; and a printer controller in electrical communication with the print head, the printer controller for determining a pulse count indicative of a number of electrical energy pulses, for applying the electrical energy pulses having a first pulse width to the resistive heating elements when the pulse count is less than a threshold value, where the printer controller determines the first pulse width according to:

$$T_1 = \frac{E_1 \times (R_T)^2}{V^2 \times R_H},$$

where $T_1$ is the first pulse width, $E_1$ is the first pulse energy value, V is the print head voltage value, $R_T$ is the total print head resistance value, and $R_H$ is the heater resistance value, and for applying the electrical energy pulses having an adjusted pulse width to the resistive heating elements when the pulse count exceeds the threshold value, where the printer controller determines the adjusted pulse width according to:

$$T_2 = \frac{E_2 \times (R_T)^2}{V^2 \times R_H},$$

where $T_2$ is the adjusted pulse width and $E_2$ is the second pulse energy value, where differences in the first pulse width and the adjusted pulse width compensate for changes in the electrical resistance of the resistive heating elements over time, thereby maintaining stable printing characteristics over time.

* * * * *